United States Patent [19]

Groshens

[11] Patent Number: 5,065,599

[45] Date of Patent: Nov. 19, 1991

[54] TEXTILE SUPPORT OF THE KNITTED TYPE AND AN INTERLINER, CLOTH AND TEXTILE ASSEMBLY

[75] Inventor: Pierre Groshens, Peronne, France

[73] Assignee: Lainiere de Picardie, S.A., Peronne, France

[21] Appl. No.: 414,734

[22] Filed: Sep. 29, 1989

Related U.S. Application Data

[63] Continuation of Ser. No. 174,412, Mar. 28, 1988, abandoned.

[30] Foreign Application Priority Data

Mar. 31, 1987 [FR] France ..... 87 04491

[51] Int. Cl.[5] ..... D04B 23/10; D04B 1/00; B32B 7/04

[52] U.S. Cl. ..... 66/84 A; 66/192; 66/193; 428/253

[58] Field of Search ..... 66/192, 193; 112/410, 112/416, 438, 440; 428/253

[56] References Cited

U.S. PATENT DOCUMENTS

| | | | |
|---|---|---|---|
| 3,570,270 | 3/1971 | Koppenburg | 66/193 |
| 4,425,398 | 1/1984 | Berczi | 428/253 |
| 4,450,196 | 5/1984 | Kamat | 428/253 X |
| 4,522,673 | 1/1985 | Fell et al. | 112/440 |
| 4,696,850 | 9/1987 | Jost et al. | 428/253 X |
| 4,704,757 | 11/1987 | Young | 428/253 X |
| 4,814,225 | 3/1989 | Kamat | 428/253 |

FOREIGN PATENT DOCUMENTS

| | | | |
|---|---|---|---|
| 739512 | 3/1970 | Belgium | 66/192 |
| 8301964 | 6/1983 | PCT Int'l Appl. | 66/192 |

OTHER PUBLICATIONS

Principles of Warp Knit Apparel Fabric Design, K. D. Darlington, The Hosiery Trade Journal, Apr. 1969, pp. 114 through 117.

*Primary Examiner*—Werner H. Schroeder
*Assistant Examiner*—John J. Calvert
*Attorney, Agent, or Firm*—Mason, Fenwick & Lawrence

[57] ABSTRACT

An interlining fabric for providing stiffening to cloth has floats at the surface thereof opposite the surface to be bonded to the cloth, the floats being formed by portions of thread of a fabric body forming a part of the interlining fabric. The fabric has a thermal bonding coating on the surface opposite the floats. A basting needle may be passed between one or more of the floats, and a textile layer, to thereby secure the textile layer to the interlining fabric, and to cloth to which it is bonded in a secure manner and without the basting thread extending through the cloth. A process for producing an interlining fabric comprising knitting a fabric, and inserting threads thereinto having floats.

7 Claims, 2 Drawing Sheets

TEXTILE SUPPORT OF THE KNITTED TYPE AND AN INTERLINER, CLOTH AND TEXTILE ASSEMBLY

This application is a continuation of application Ser. No. 07/174,412 filed Mar. 28, 1988, now abandoned.

BACKGROUND OF THE INVENTION

The present invention relates to an interlining fabric, to a process for producing it, and to an interlining fabric bonded to a cloth and having a textile layer basted to it.

It is known to provide stiffening to cloth by bonding an interlining to the cloth. For example, clothing such as men's jackets comprise an outer layer of cloth which may be flaccid, there being joined to the cloth a layer of interlining material of, optionally, greater stiffness than the cloth. The interlining provides to the cloth an improved "hand", volume, and increased stiffness. Further, during manufacture of, for example, clothing, the addition of an interlining makes it possible to baste to a cloth a second textile layer, which may be a lining. This is done by basting thread which extends through the second textile layer, and, preferably, into the interlining, without penetrating the cloth. When this is achieved, the basting stitches are not visible from the exterior of the cloth, which is the exterior of the finished product, such as clothing.

In the known constructions of providing interlining fabric, warp knit fabric is used, which may have inserted weft threads. This known interlining fabric has smooth and flat surfaces. The interlining may be secured to the cloth by conventional thermal bonding technique, and then the second textile layer is secured in place by a stitching operation called basting. Basting is a difficult operation which requires very accurate positioning of the basting needle in relation to the structure including the second textile layer, the interlining and the cloth. If the basting needle is too near the cloth, basting thread will pass through the second textile layer, the interlining and the cloth, thus causing the basting stitches to be visible on the outer face of the cloth. If, to the contrary, the basting needle is too far away from the cloth, the basting thread will not catch on the interlining fabric, and the desired fastening will not be obtained.

An object of the present invention is to provide an interlining fabric which will facilitate the securing by basting of a second textile layer to the interlining, in a secure and facile manner, and without stitching which is visible on the side of the cloth opposite the second textile layer.

SUMMARY OF THE INVENTION

An interlining fabric is provided which preferably includes a fabric body which is warp knitted, and with floats at one surface thereof. The floats are portions of inserted weft threads. Floats are distributed over at least one of the faces of the interlining fabric, the floats being capable of being somewhat above that surface. The floats enable basting thread to catch the floats of the fabric, to secure a second textile layer to the interlining layer.

The invention also comprises a composite fabric including a cloth, an interlining fabric thermally bonded to the cloth, the surface of the interlining fabric opposite the cloth having floats adjacent thereto, a second textile layer, and basting thread securing the second textile layer to the interlining fabric by basting thread passing between one or more of the floats and the fabric body of the interlining fabric.

The invention also comprises a process for making an interlining fabric comprising knitting a fabric body, and inserting weft threads thereinto so that portions of the weft threads are floats. The weft threads pass over the under successive rows or casts of stitches which form the knitted fabric body, thereby producing floats of some portions of the weft threads.

DESCRIPTION OF THE PREFERRED EMBODIMENTS

Figure 1:
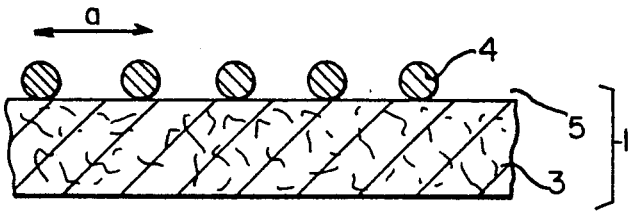
FIG. 1 is a cross-sectional view of an interlining fabric in accordance with the present invention.

There is shown in FIG. 1 an interlining fabric 1 which is preferably of the knitted type and which is to be used, in known fashion, as a stiffening for a layer of cloth. It comprises a fabric body 3 having threads 4 with portions which are above the free surface 5 of fabric body 3. Threads 4 may be warp threads inserted into a knit fabric, as set forth below. The free surface 5 of the fabric body 3 is defined by the stitches of the fabric body 3 where fabric body 3 is a knit fabric body.

Portions of threads 4 have a looseness, providing floats, which results from the thread 4 being above the free surface 5; the purpose of this construction is to permit a basting thread to catch under the looseness or float of thread 4.

Figure 2:
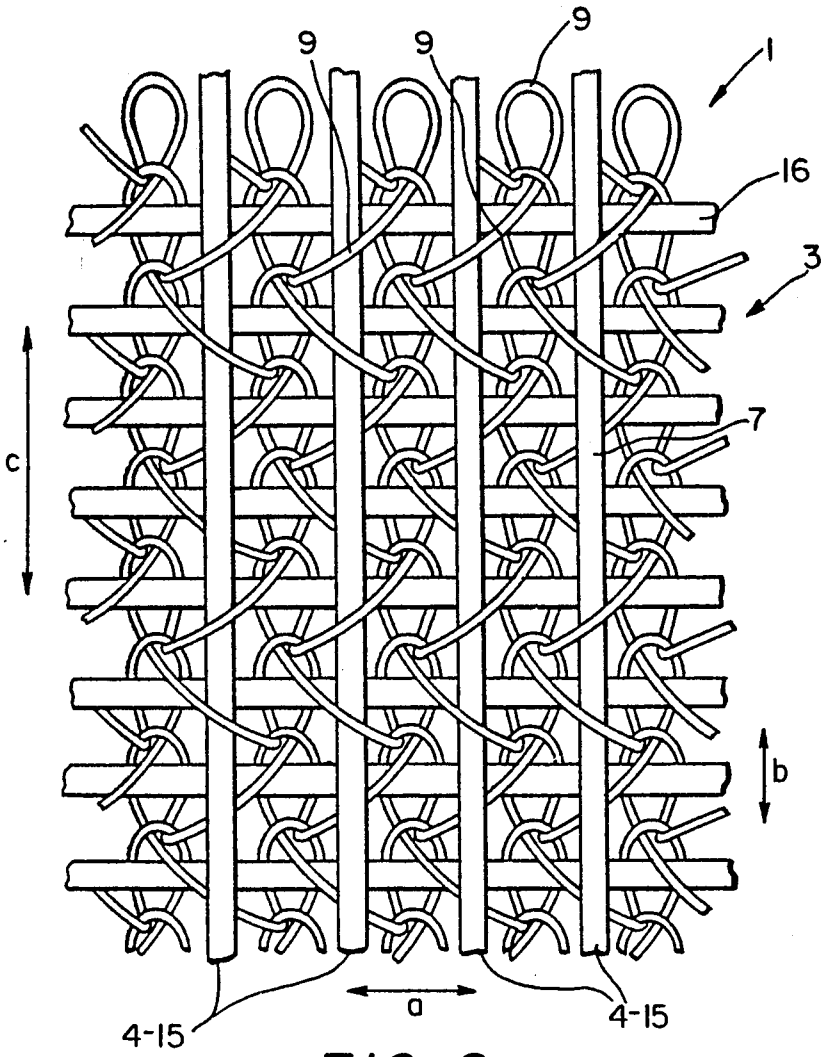
FIG. 2 is a plan view of an interlining fabric according to a first embodiment of the invention.

Referring now to FIG. 2, there is shown the interlining fabric 1 in accordance with the present invention, the interlining fabric 1 being formed by rows or casts 9 of stitches which form a knitted fabric. Warp threads are generally designated 4; specific warp threads are designated by 4–15, 14–17 and 14–18. Warp threads 4–15 are inserted to form, with the knitted fabric, the fabric body 3; weft threads 18 may be inserted in the fabric body in the weft direction. The warp threads 4-15 each extends over several portions of the thread forming the casts 9, and under some of the portions of them. In the embodiment illustrated, the warp threads extend over two successive portions of the thread forming casts 9, and then, successively, under the next two portions, etc. The portions of the warp threads 415 which extend over the portions of the casts 9 of the stitches are loose, forming floats. In the embodiment of FIG. 2, the floats 7 of one warp thread 4–15, which will be understood to be a specific one of the threads 4 in FIGS. 1 and 3–6, are in line with the floats of the adjacent warp thread 4–15. Weft threads 16 may also be inserted in fabric 3.

Figure 3:
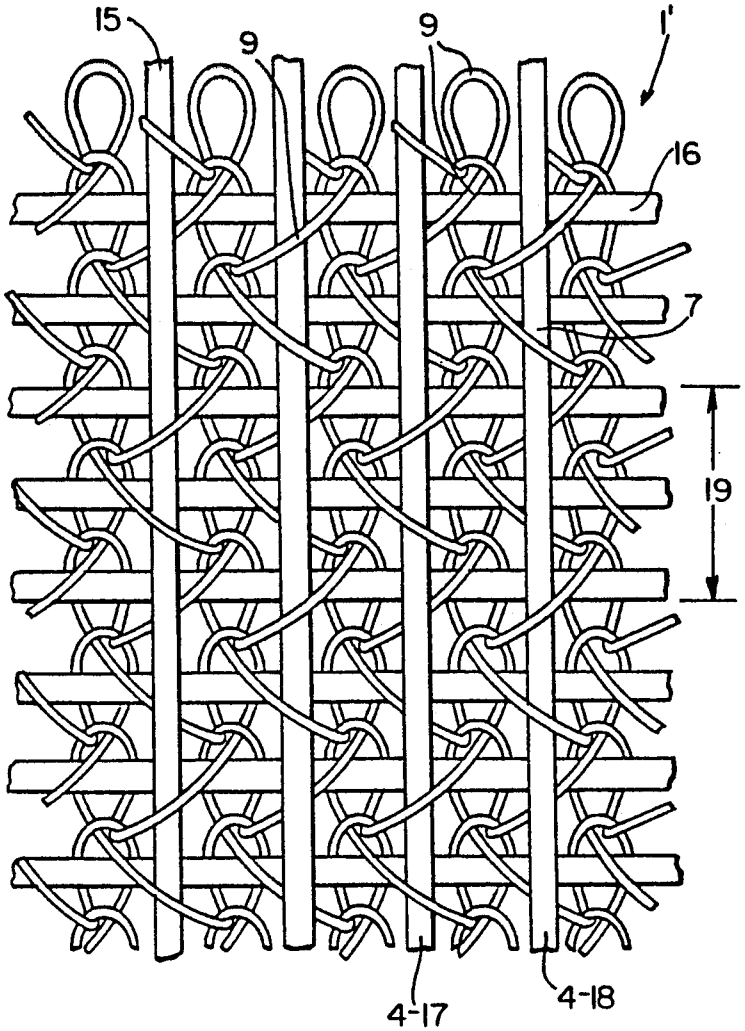
FIG. 3 is a plan view of an interlining fabric in accordance with a second embodiment of the present invention.

In FIG. 3, there is an alternate embodiment of an interlining fabric 1' in which the floats of the warp threads 4–17 and 4–18 are not in line, but are in staggered relationship.

The inserted warp threads 4–15 having the floats 7 thereon are spaced apart a distance a which is substantially the same as the length of a stitch b. The length of the floats 7 may range from one to a few stitches b, and particularly from one up to about two to five times the length b of a stitch of the knitted fabric 3. Preferably, the floats 7 are distributed substantially uniformly over the surface of the interlining fabric 1 and 1', in the embodiments of the invention, such as those shown in FIG. 2 and in FIG. 3.

The threads 4–15, etc. are inserted by conventional means such as guide bars and suitable insertion means. The guide bars (not shown) are adjusted in such a way that the threads pass on the same side of several rows or casts 9 of loops or stitches forming the knitted fabric body 3. The result of this is to produce the floats 7, formed by loose portions of the weft threads 4, i.e., 4–15, etc., and which may be at a distance from the adjacent surface of the knit fabric body 3.

Insertion of the warp threads 4–15, etc. may be effected so as to vary the characteristics of the resulting structure. The number of rows or casts 9 of the stitches of the knitted fabric body 3, on the same side of which an inserted warp thread 4–15, etc. passes, is the number of these casts 9 for which the undercasts of the weft thread is 0. It is this number which determines the length of the float 7 produced from the looseness of the threads 4–15, etc.

The floats 7 in each of the threads 4–15 (FIG. 2) and 4–17, 4–18 (FIG. 3) are produced as a result of the passage of these threads on the same sides of several rows or casts 9 of the stitches forming the fabric body 3. They may be straight or parallel to the stitch wales of the knit fabric body 3, or have under-casts giving them a desired arrangement. When the threads 4–15, etc. pass on the same side of several rows of casts 9, the loops of the stitches forming the knitted fabric body 3, that is, undercasts of these stitches, they acquire a looseness which gives them desired float.

The loose floats 7, over all or part of their length, pass above the free surface 5. This looseness or float is the relief obtained by virtue of the threads 4–15 not being held by all of the sides of the loops or undercast 9, as shown in FIGS. 2 and 3, of the knitted fabric body 3. The threads 4 may extend only on the free surface 5 provided by the face 10, but may, optionally, be also provided at the opposite face 11.

It is preferred that the floats 7 are formed from warp threads, and are located between the loops, the length of the floats corresponding to at least two rows or casts 9 of the stitches. This preferred embodiment insures a good working connection between the inserted warp threads and the knit fabric body 3, with sufficient looseness of the floats 7.

The above mentioned weft threads 16 improve the mechanical strength of the interlining fabric 1, and contribute to the basting operation by making that operation easier and reinforcing the hold of the threads 4–15, etc. The warp threads 4–17 and 4–18 of FIG. 3 are offset longitudinally relative to one another by a length which is at least equal to the length 19 of a float 7. Consequently, whatever the longitudinal position of the basting needle during its movement, it will encounter a float 7 at a point near the point least distant from the fabric body 3.

It is recognized that an interlining fabric 1 having a high density of threads 4 with floats 7 is desired, the density of knitting needles of the knitting machine may limit the density of the inserted warp threads 4 and therefore of the floats 7. In order to accomplish the goal of high density in this situation, a weft thread 16 having the ability to shrink during finishing is used. Thus, upon the occurrence of the shrinking, the density of the floats 7 in the resulting interlining fabric 1 or 1' is thereby increased, and can be made higher than that which can otherwise be achieved. The amount of shrinkage of the weft thread 16 may be selected to determine the final density of the floats 7. This shrinkage may occur during the finishing as the result of, for example, successive operations of washing, dyeing and heat treatment.

Figure 4:
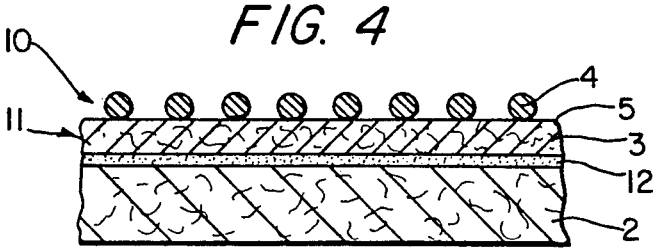
FIG. 4 is a cross-sectional view of an interlining fabric adhered to a cloth.

Referring now to FIG. 4, the fabric body 3 is shown bonded by thermal bonding material 12 to a cloth 2; the cloth 2 may be, for example, the outer layer of a garment.

In the preferred embodiment of the invention, the fabric 3 has floats 7 on only one of its faces, the other face 11 of the fabric 3 being substantially smooth and even. This construction of the other face 11 facilitates the assemblage of the interlining 3 to the cloth 2 by means of a thermal bonding material, such as a hot-melt adhesive 12.

Figure 5:
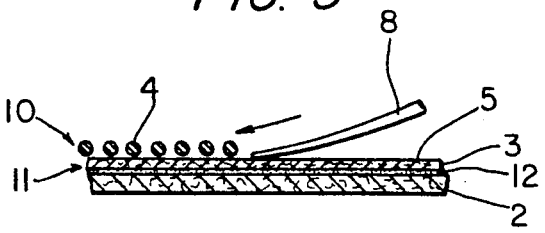
FIG. 5 is a cross-sectional view similar to FIG. 4, on a reduced scale, and showing a basting needle.

FIG. 5 is a cross-sectional view showing threads 4, which may be the warp threads 4–15 of FIG. 2 or the warp threads 4–17, 4–18 of FIG. 3; FIG. 5 shows floats 7 of these threads, and a basting needle 8 for carrying a basting thread (not shown in FIG. 5). As will be apparent, the floats 7 of the thread 4, being above the free surface 5 of the fabric body 3, readily permits the basting needle to pass beneath them, between the floats 7 and the adjacent surface of fabric body 3.

Figure 6:
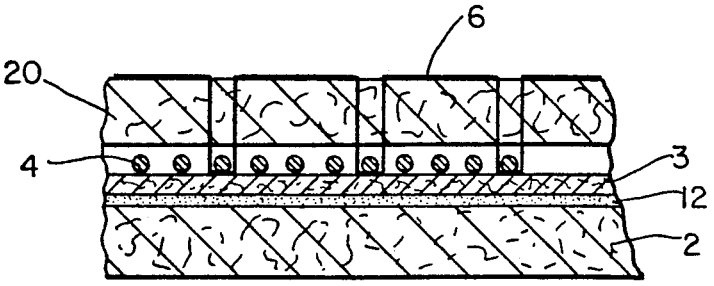
FIG. 6 is a cross-sectional view of an interlining fabric adhered to a cloth and with a textile layer secured thereto by basting thread.

In FIG. 6, there is shown the cloth 2, with the fabric body 3 bonded to it by thermal bonding material 12, and with a basting thread 6 securing a second textile layer 20 to the threads 4, and thus to the fabric interlining 1 and the cloth 2 to which the latter is adhered or bonded. The second textile layer may be an inner lining of a garment.

The securement of the second textile layer 20 is with engagement of the basting thread 6 with a sufficient number of the threads 4. The basting threads 6 do not extend into or through the cloth 2. Accordingly, a secure attachment is attained without the basting thread 6 being visible from the lower surface of cloth 2 (as shown in FIG. 6) which will be understood to be exterior or visible surface of the completed assembly.

I claim:

1. A structure comprising an interlining fabric, and means on one surface of said fabric for joining said fabric to a cloth in facing relationship of said one surface to the cloth, said interlining fabric comprising a fabric body having a free surface opposite said one surface, said fabric body further comprising means for receiving a basting thread for securing a second cloth to said interlining fabric, said basting thread receiving means comprising threads with floats of sufficient looseness that they may extend in spaced relation to said free surface.

2. The structure according to claim 1, said fabric body having threads with floats only on one of the surfaces of said fabric body.

3. The structure according to claim 1, wherein said fabric body comprises knitted fabric comprising rows of loops of thread, said floats being spaced at a distance of approximately the length of a said loop of the knitted fabric.

4. The structure according to claim 1, wherein the length of the floats is in the order of the length of one to approximately five of the stitches of said knitted fabric comprising said fabric body.

5. The structure according to claim 1, wherein said floats are distributed substantially uniformly over said free surface of said fabric body.

6. In combination, (a) a cloth, (b) a fabric body having floats of threads at and capable of being spaced from a free surface thereof, (c) thermal bonding material between the opposite surface of said fabric body and said cloth and bonding said fabric body to said cloth, (d) a textile layer overlying at least a part of the free surface of said fabric body, and (e) at least one basting thread passing through at least part of said textile layer and between at least one of said floats and said fabric body for securing said textile layer to said fabric body and said cloth, (f) said basting thread not extending on the surface of said cloth opposite said fabric body.

7. The combination of claim 6, wherein said fabric body comprises knitted fabric having inserted warp threads, said floats being portions of said inserted warp threads.

* * * * *